US007590254B2

(12) United States Patent
Olsen

(10) Patent No.: US 7,590,254 B2
(45) Date of Patent: Sep. 15, 2009

(54) HEARING AID WITH ACTIVE NOISE CANCELING

(75) Inventor: Jes Olsen, Smørum (DK)

(73) Assignee: Oticon A/S, Smorum (DK)

( * ) Notice: Subject to any disclaimer, the term of this patent is extended or adjusted under 35 U.S.C. 154(b) by 168 days.

(21) Appl. No.: 10/580,038

(22) PCT Filed: Nov. 18, 2004

(86) PCT No.: PCT/DK2004/000796

§ 371 (c)(1),
(2), (4) Date: Feb. 28, 2007

(87) PCT Pub. No.: WO2005/052911

PCT Pub. Date: Jun. 9, 2005

(65) Prior Publication Data

US 2007/0172087 A1 Jul. 26, 2007

(30) Foreign Application Priority Data

Nov. 26, 2003 (DK) ..... 2003 01744

(51) Int. Cl.
*H04R 25/00* (2006.01)

(52) U.S. Cl. ..... 381/328; 381/317

(58) Field of Classification Search ..... 381/23.1, 381/71.6, 312, 317, 328, 380
See application file for complete search history.

(56) References Cited

U.S. PATENT DOCUMENTS

| | | | | |
|---|---|---|---|---|
| 4,985,925 | A | 1/1991 | Langberg et al. | |
| 5,033,090 | A | 7/1991 | Weinrich et al. | |
| 5,740,258 | A | 4/1998 | Goodwin-Johansson et al. | |
| 6,445,799 | B1 | 9/2002 | Taenzer et al. | |
| 6,567,524 | B1 * | 5/2003 | Svean et al. | 381/314 |
| 2003/0147544 | A1 | 8/2003 | Lichtblau | |

FOREIGN PATENT DOCUMENTS

| | | | |
|---|---|---|---|
| DE | 40 10 372 | A1 | 10/1991 |
| EP | 1 499 159 | A | 1/2005 |

* cited by examiner

*Primary Examiner*—Brian Ensey
(74) *Attorney, Agent, or Firm*—Birch, Stewart, Kolasch & Birch, LLP

(57) ABSTRACT

The invention relates to a hearing aid comprising a signal path with an input transducer, a signal processor and an output transducer, the signal processor being adapted to produce a compensation signal capable of at least partly attenuating acoustic signals bypassing the signal path and entering the ear canal.

7 Claims, 2 Drawing Sheets

HEARING AID WITH ACTIVE NOISE CANCELING

The invention relates to hearing aids, more specifically to hearing aids including means for receiving non-audio input signals.

BACKGROUND OF THE INVENTION

In hearing aids, which beside the transducers for receiving an audio input include means for receiving a non-audio input signal, e.g. a RF receiver, a telecoil for receiving magnetically transmitted signals, there is a possibility of loosing the information transmitted and received as a non-audio signal due to disturbance from the surrounding audio environment.

Hearing aids including noise reduction are well known. The noise reduction is hereby implemented in a way that enables the reduction of unwanted audio signal parts in the audio signal that is processed in the hearing aid, i.e. in the audio signal that is being processed in the hearing aid, by a spectral subtraction. A requirement for performing such noise or audio signal reduction is that the unwanted signal propagates through the hearing aid signal path.

This may in many situations provide a satisfactory result, however in situations where the signal cancellation is not sufficient there is still room for improvement. Especially in situations where a possibility exists for a significant part of the audio signal to propagate into the ear canal bypassing the hearing aid signal path, which normally includes a microphone, a processor and a receiver.

The objective of the present invention is therefore to provide a hearing aid, which provides noise reduction in situations where the previously known noise reduction will not provide a satisfactory result.

SUMMARY OF THE INVENTION

According to the invention this is achieved by means of a hearing aid comprising a signal path with an input transducer, a signal processor and an output transducer, where an auxiliary input is provided to the signal path, the signal processor being adapted to produce a compensation signal capable of at least partly attenuating acoustic signals bypassing the signal path and entering the ear canal.

By means of such hearing aid it is possible to at least attenuate sound signals that may bypass the signal path and enter the ear canal where the sound signal despite the hearing aid users hearing loss may cause disturbance in case an auxiliary signal is received, e.g. through a wireless or wired connection. This problem becomes increasingly important when a so-called open canal fitting is used in order to reduce the occlusion phenomena.

In an advantageous embodiment the hearing aid further comprises an internal input transducer for obtaining a sound signal within an ear canal, the internal input transducer being connected to the signal path.

When an auxiliary input is provided to the signal path, switching means are advantageously provided for switching to a state where the compensation signal is generated. The switching means are advantageously adapted for automatically generating the compensation signal upon receiving the additional input.

The invention will be explained more detailed in connection with the following description of a preferred embodiment with reference to the drawings.

DESCRIPTION OF A PREFERRED EMBODIMENT

Figure 1:
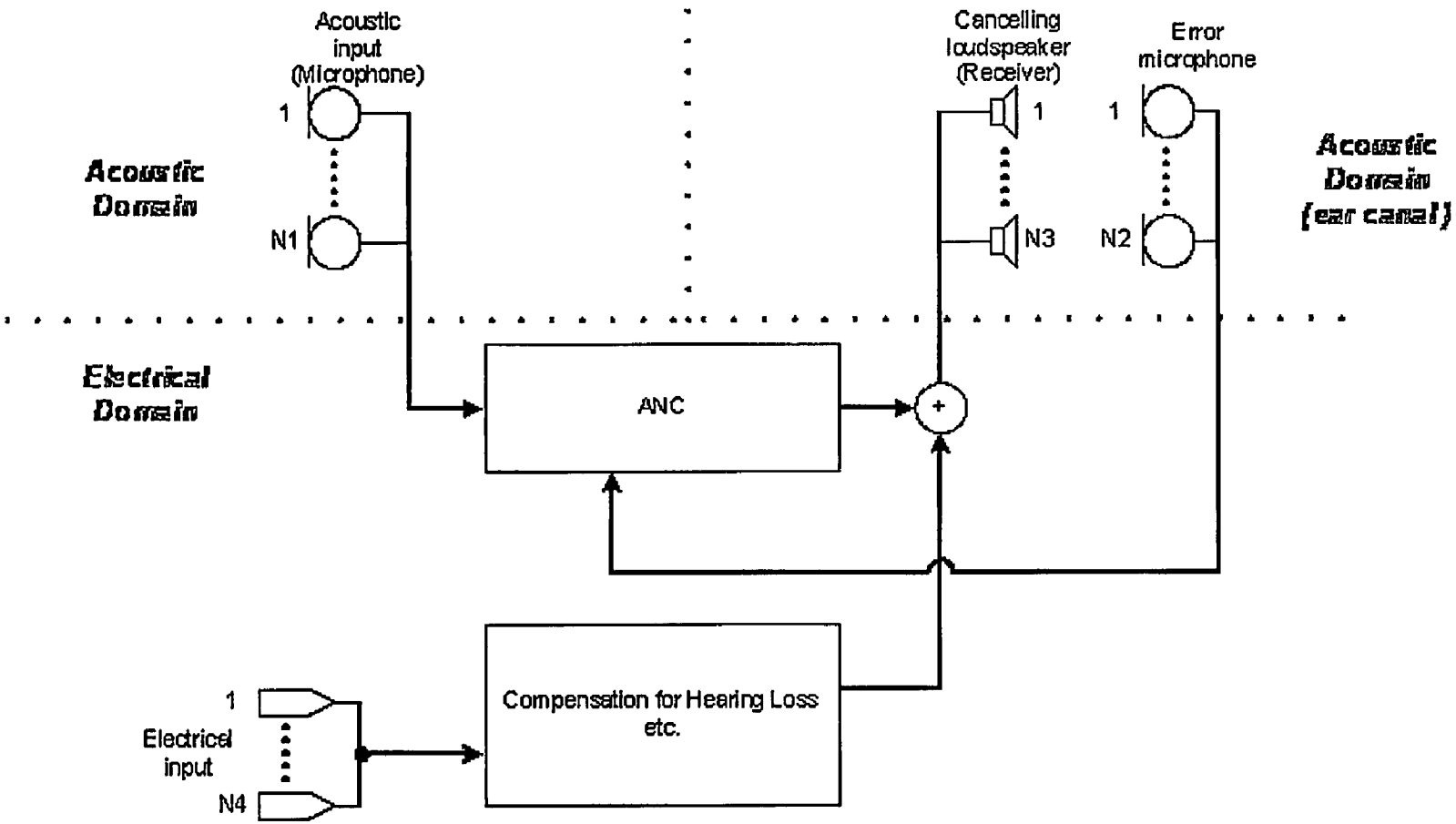
FIG. 1 is a schematic drawing showing the principles of the invention.

From FIG. 1 a schematic representation of a hearing aid appears featuring the noise cancellation according to the invention. The hearing aid comprises a signal path with one or more external input transducers 1-N1, a signal processor performing compensation for hearing loss as well as the Noise cancellation part (ANC) and one or more output transducers 1-N3. In addition to this the signal path comprises one or more further input transducers 1-N2 placed internally, i.e. facing the interior of the ear canal or being integrated into the receiver, when the hearing aid is mounted. The internal input transducer(s) or error microphone(s) provides the signal present in the ear canal and feeds this to the signal processor, which generates a error signal capable of adjusting the attenuation signal and hence at least partly attenuate the undesired signal present in the ear canal. One or more separate output transducers are provided for the output of the compensating signal, where these correspond to those used for the normal hearing aid function. The compensation signal may be based on the input to the external input transducers 1-N1, which input correspond to the signal that is undesirable and where the compensation signal may be established based on this, e.g. by changing the phase of this and further adjusting this based on the actual conditions present.

The hearing aid comprises further electrical input means 1-N4, e.g. a wireless receiver or a direct audio input receiver, which may be of any kind, e.g. a telecoil receiver or a radio frequency receiver. Means are preferably provided for attenuating the external input transducer signal, or switching this off.

Figure 2:
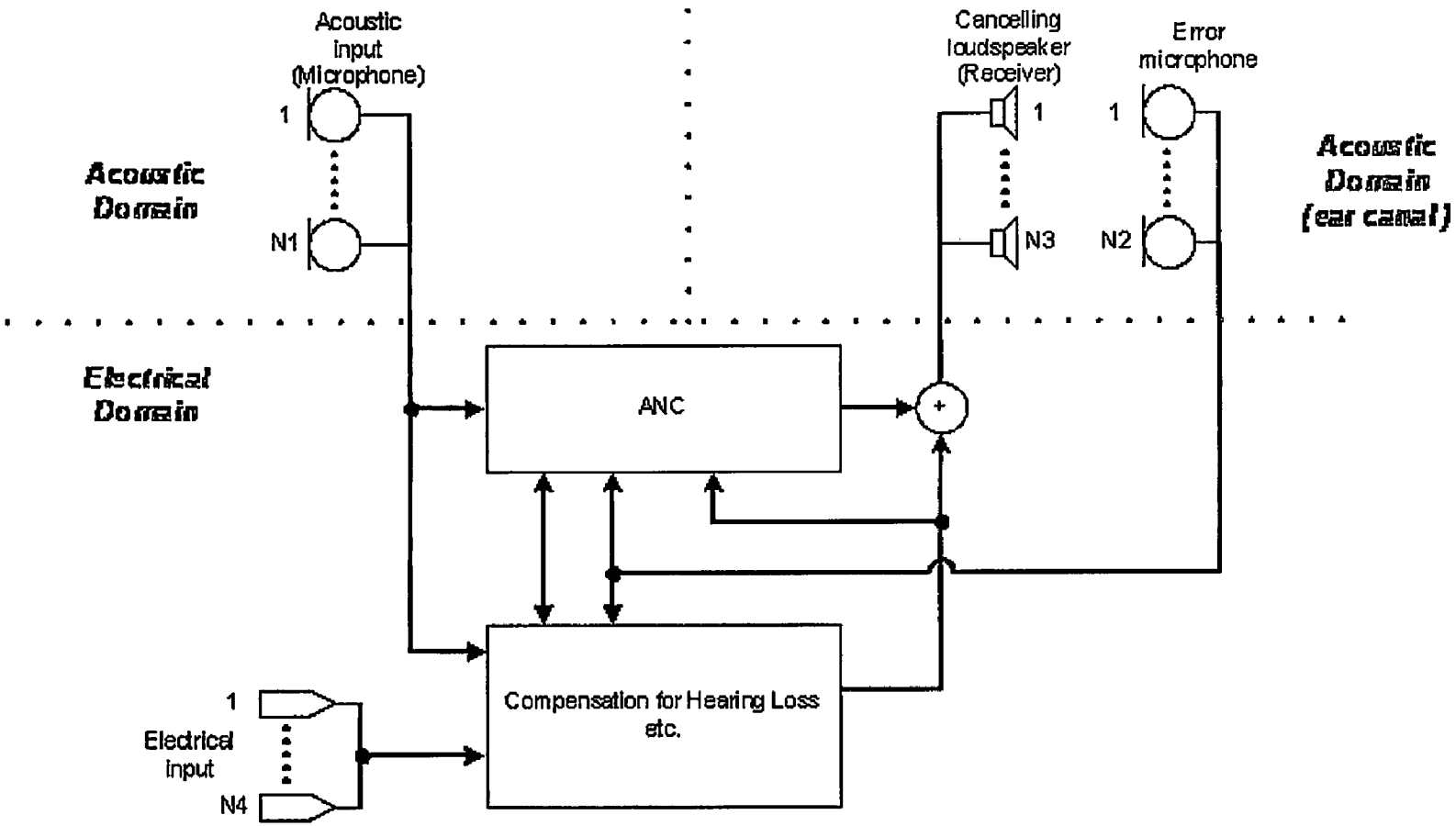
FIG. 2 is a schematic drawing showing the principles of a second embodiment of the invention.

From FIG. 2 a further embodiment appears where additional communication is established between the input and the hearing loss compensation and between the ANC and the hearing loss compensation.

In connection with the use of hearing aids there is most often a need for snugly fitting the hearing aid itself or an ear mould to the shape of the ear canal in order to avoid acoustic feedback. This normally existing requirement will to some extent provide remedy for the reduction of the level of the sound signal bypassing the signal path from the outside. In some systems there is however signal processing capabilities, including feedback cancellation, that enables the use of so-called open fittings, where a totally open ear canal or at least a significant opening in the hearing aid or the ear mould or around a tubing leading into the ear canal may be provided and hereby reduce the occlusion phenomena. It is obvious that such open fitting significantly will increase the possibility of sound signals bypassing the signal path. Hence the invention in this situation will have an even more significant impact.

The invention claimed is:

1. A hearing aid comprising:

an open fitting to reduce occlusion;

a signal path with an external input transducer;

a wireless receiver or a direct audio input receiver providing an auxiliary electric input to the signal path;

an attenuation portion that attenuates the external input transducer signal or switches it off;

at least one internal input transducer that obtains a sound signal within the ear canal, said internal transducer being connected to said signal path;

a signal processor that produces a compensation signal that at least partly attenuates acoustic signals bypassing the signal path and entering the ear canal; and an output transducer that produces an output audio signal based on said compensation signal.

2. A hearing aid according to claim 1, the signal processor further comprising a switch that activates generation of the compensation signal when said auxiliary input is provided.

3. A hearing aid according to claim 2, where the switch is automatically activated upon receiving the auxiliary input.

4. A hearing aid according to claim 1, the hearing aid having at least one significant opening in the hearing aid or an ear mould or around a tubing leading into the ear canal.

5. A hearing aid according to claim 1, wherein the wireless receiver is a telecoil receiver that receives magnetically transmitted signals, or a radio frequency receiver.

6. A hearing aid according to claim 1, where said signal processor produces said compensation signal based on the sound signal within the ear canal obtained by the internal input transducer.

7. A hearing aid according to claim 1, where said signal processor produces said compensation signal based on input to said external input transducer.

* * * * *